United States Patent [19]

Duncan et al.

[11] 4,261,325

[45] Apr. 14, 1981

[54] AIRTIGHT STOVE WITH DRIPLESS FLUE COLLAR AND COVER PLATE ASSEMBLY

[75] Inventors: William D. Duncan; Joseph I. Beveridge, both of Mt. Vernon; Bruce S. Hampton, Opdyke, all of Ill.

[73] Assignee: Midwest Stoves, Inc., Mt. Vernon, Ill.

[21] Appl. No.: 49,709

[22] Filed: Jun. 18, 1979

[51] Int. Cl.[3] ..... F24C 15/08; F23J 11/00; F23J 13/00; F24C 1/00

[52] U.S. Cl. ..... 126/82; 126/307 R; 126/315; 126/58

[58] Field of Search ..... 126/82, 307 R, 307 A, 126/58, 315

[56] References Cited

U.S. PATENT DOCUMENTS

| | | | |
|---|---|---|---|
| 557,775 | 4/1896 | Dimmock | 126/77 |
| 629,544 | 7/1899 | Cadman | 126/77 |
| 635,566 | 10/1899 | Milburn | 126/152 R |
| 960,904 | 6/1910 | Hancock | 126/152 R |
| 1,179,995 | 4/1916 | Beckwith | 126/307 R |
| 2,026,387 | 12/1935 | Jackes et al. | 126/65 |
| 2,709,999 | 6/1955 | Nagel | 126/307 |
| 4,118,173 | 10/1978 | Shakiba | 126/307 |

FOREIGN PATENT DOCUMENTS

| | | | |
|---|---|---|---|
| 666 | of 1904 | United Kingdom | 126/307 |
| 127505 | 1/1919 | United Kingdom | 126/307 |

*Primary Examiner*—Albert W. Davis
*Assistant Examiner*—Wesley S. Ratliff, Jr.
*Attorney, Agent, or Firm*—Jones, Tullar & Cooper

[57] ABSTRACT

An airtight steel stove having a dripless top or rear flue collar and cover plate assembly is disclosed. The stove is provided with similar openings in a top wall and a rear wall. Interchangeable flue collar and cover plate assemblies allow the stove to be used either as a top flue or rear flue type by placing the flue collar and cover plate assemblies as desired. The flue collar has an inside diameter sized to receive a stove pipe therewithin. This eliminates drippage of creosote and other similar products of combustion onto the outside of the stove. Instead, such materials are returned to the interior of the stove.

1 Claim, 8 Drawing Figures

AIRTIGHT STOVE WITH DRIPLESS FLUE COLLAR AND COVER PLATE ASSEMBLY

FIELD OF THE INVENTION

The present invention is directed generally to an airtight steel stove. More particularly the present invention is directed to such a stove having interchangeable flue collar and cover plate assemblies. Most specifically the present invention is directed to an airtight steel stove having a drip free flue collar assembly and an interchangeable cover plate assembly.

An airtight steel stove is provided with similar openings in its top and rear walls. A flue collar assembly is positioned in one such opening and a cover plate assembly is placed in the other. The two assemblies are each structured to fit in either opening thus allowing the stove to be either a top flue or a back flue type depending on the needs of the owner.

The flue collar has a tapering inner diameter so that a stove pipe may be placed snugly therein. Creosote and other products of combustion, which are apt to collect on the inside of the stove pipe, will run down the inside of the stove pipe and return to the stove's combustion chamber instead of running out onto the surface of the stove.

DESCRIPTION OF THE PRIOR ART

Stoves for use in home heating and cooking are generally well known in the art. Before the advent of central heating, such stoves were used to heat the home as well as for preparation of food. Traditionally, such stoves were made of cast iron sections which were bolted together and attached to a chimney or the like by a stove pipe. These stoves were not particularly efficient and were not airtight.

The use of wood burning stoves for home heating has enjoyed increased interest in the last few years because of the increasing costs of the now conventional heating means such as oil and gas fired furnaces. In some instances, wood stoves are again being used as the sole heat source but more frequently they are being used as an alternative heat source or as a supplement to the main heat source.

The stoves being used currently are often of welded steel construction and are airtight to promote efficient combustion of the wood being burned. Such stoves, however are apt to produce creosote and other similar by-products of combustion because they product a cooler fire than did their cast iron, non-airtight predecessors. The creosote, which is formed during burning, collects in the stove pipe and eventually runs down the pipe and out onto the stove at the junction of the pipe and flue collar. This creosote detracts from the appearance of the stove and also creates a fire hazard since it could ignite if the stove were to become hot enough.

Airtight welded steel stoves are formed by welding various steel plates together to form the body of the stove. A flue collar is then welded in place so that a stove pipe can be connected. The welding of the flue collar to the stove body is a costly production step since the collar must be made separately and then attached in an additional welding step. Additionally, the welding of the flue collar to the stove body causes splattering of the welding material and increases cleanup costs.

Stoves are either made with the flue collar on the top or in the rear. The retail seller of stoves must maintain an inventory of both types of stoves so he can supply his customers. The manufacturer in turn, must produce both top and rear flue collar arrangements to supply to his dealers. The manufacture, stocking, and distribution of both top and rear flue assembly units increases the costs and inventory requirements of both the manufacturer and the seller. No matter how much effort is spent in planning and attempting to anticipate customer preferences, the inevitable result is that whichever unit the seller has on stock, the customer wants the other.

A related problem with the manufacture and shipping of two separate types of stoves is one of packaging. The flue collar protrudes from either the top or rear of the stove and this protrusion must be considered when boxing the stove for shipment. If a carton is made large enough to accept either configuration, then packing or padding must be used to prevent shifting. If two alternate sizes of containers are used, an inventory problem is again created.

The average homeowner moves every seven years and since the expected life of the stove is longer than that period, the purchaser may be faced with the problem of having a stove which is not suited for the new home he is moving to. Either the stove or the chimney to which the stove pipe will be connected must then be modified before the stove can be used in the new location.

A stove which is generally similar to the present invention is shown in U.S. Pat. No. 960,904 to Hancock. This patent shows a combination cast iron and sheet metal stove which has a top opening ending in an integral flange. A similar opening is provided in the rear of the stove and an interchangeable cap is provided. The flanges are integrally formed with the top and rear of the stove and add to the manufacturing costs and shipping expense of the stove. This stove assembly further does not provide a creosote drip-free connection for the stove pipe and does not provide a cover plate which is flush with the surface of the stove.

SUMMARY OF THE INVENTION

It is an object of the present invention to provide an airtight steel stove having a dripless flue collar.

Another object of the present invention is to provide a steel stove having reduced manufacturing costs.

A further object of the present invention is to provide a stove having means for placing the flue collar either at the top or rear of the stove.

Yet another object of the present invention is to provide a stove which reduces inventory and shipping costs.

As will be set forth in greater detail in the description of a preferred embodiment, the stove assembly in accordance with the present invention is an all steel airtight, welded assembly having similar openings in the top and rear walls. A flue collar and a cover plate assembly are provided with each stove and these two assemblies fit either of the openings in the stove. Thus, the flue collar assembly can be placed either on the top wall or rear walls as desired.

The flue collar assembly of the present invention is formed with a tapered inside diameter of a size to allow the insertion of the stove pipe therein. As the stove pipe is pushed downwardly into the flue collar, it forms a snug fit with the collar. Any creosote or other residue will then run down the inside of the pipe and flue collar and will return to the combustion chamber thereby eliminating drips and the collection of any residue on the outside of the stove.

The flue collar and cover plate assemblies are not welded to the stove body but are attached by bolts or screws. Thus, the manufacture of the stove is simplified and less cleanup of weld splatter is required. This reduction in manufacturing costs can be passed on to the purchaser as reduced purchase cost.

The stove assembly of the present invention also substantially reduces costs of inventory and storage. Each stove can either have a top or rear flue collar depending on the requirements of the customer. The manufacturer makes all his stoves with a top opening and a rear opening. He provides his distributor or seller with a unit which the seller can structure to meet customer requirements. Accordingly, there is no longer a problem of not having the unit the customer wants. Each stove can be either a top flue or rear flue unit simply by placing the flue collar and cover assemblies as required.

Costs of packaging are also reduced because the flue collar is attached after the unit has been shipped to the dealer. A standard size carton or box can be used without the requirement of additional packaging or fillers to prevent shifting. This cost reduction can again be passed on to the buyer.

The flue collar and cover plate assemblies can be removed and switched should this become necessary at any time after purchase of the stove. The stove can be changed by the homeowner to adapt the configuration of the stove to a new house or to another room in the house should the stove's owner require this flexibility. As a result, the stove will have a longer life and will be of more value to its purchaser.

The flue collar and cover plate assembly of the present invention provide an airtight welded steel stove which has reduced manufacturing costs, which substantially reduces inventory and storage costs, and which provides the purchaser with a stove that will fit his particular requirements be they a top flue collar or a rear flue collar. The stove eliminates unsightly accumulations of creosote at the flue collar's connection with the stove pipe and provides a stove which is eye-appealing, rugged, reliable, and easy to ship and assemble.

BRIEF DESCRIPTION OF THE DRAWINGS

While the novel features of the airtight stove with dripless flue collar and cover plate assembly in accordance with the present invention are set forth with particularity in the appended claims, a full and complete understanding of the invention may be had by referring to the detailed description of a preferred embodiment as set forth hereinafter and as shown in the accompanying drawings in which:

DESCRIPTION OF A PREFERRED EMBODIMENT

Figure 1:
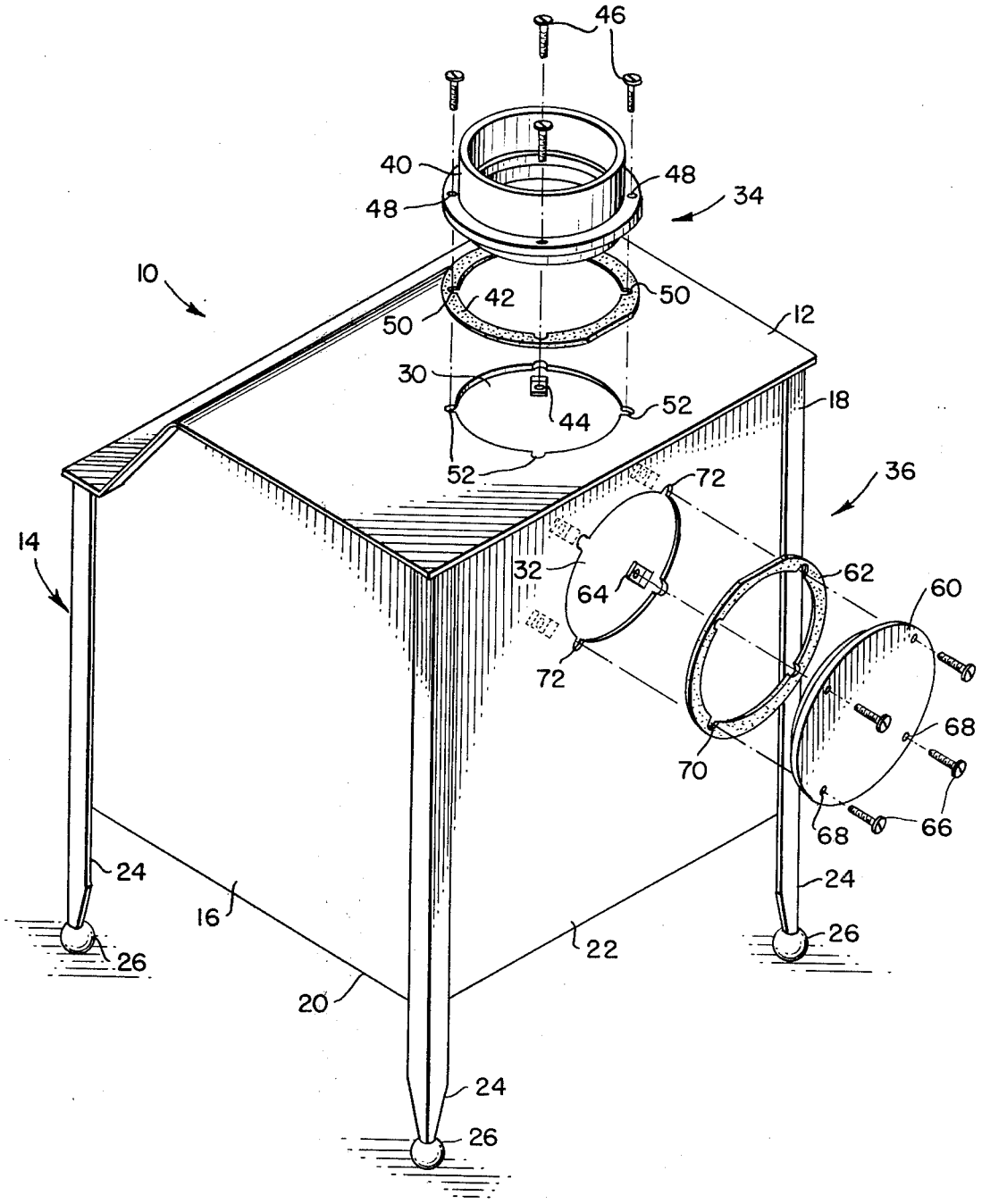
FIG. 1 is an exploded perspective view showing the airtight stove with dripless flue collar and cover plate assemblies in accordance with the present invention.

Referring initially to FIG. 1, there may be seen, generally at 10, a preferred embodiment of an airtight welded steel stove with a dripless flue collar and cover plate assembly in accordance with the present invention. Stove 10 is of steel construction and is welded together to form an airtight assembly. Stove 10 has a top 12, a front wall 14, spaced side walls 16 and 18, a bottom 20 and a rear wall 22. These elements are formed from steel plate of $\frac{1}{4}''$ and 5/16″ thickness, in the preferred embodiment, with all the seams and connections being welded. Stove 10 is supported by suitable legs 24 which may terminate in support feet 26. Although not shown, it will be understood that stove 10 has a suitable door in front wall 14 and that this door or doors carry sealing gaskets to prevent air flow. All air flow into stove 10 is through an adjustable damper (not shown) situated in the door or doors of the stove. In the preferred embodiment, the stove is approximately 36″ high, 30″ wide and 30″ deep and has a combustion chamber lined with suitable firebrick.

As may also be seen in FIG. 1, the top surface 12 of stove 10 is formed with an opening 30 placed equidistant from both sides walls 16 and 18 and near the rear wall 22. A similar opening 32 is formed in rear wall 22, spaced between the side walls 16 and 18 and near the top wall 12. While the exact positioning of these two openings is not critical, it is important that they be the same size and shape as each other for it is these openings which receive a flue collar assembly 34 and a cover plate assembly 36, as shown in exploded perspective in FIG. 1.

Flue collar assembly 34, as may be seen in FIG. 1, is composed of a flue collar 40, a suitable annular sealing gasket 42, and suitable securing nuts 44 and bolts 46. Bolts 46 pass through bolt holes 48 in collar 40, through cut-outs 50 on the inner circumference of gasket 42, and through similar cut-outs or notches 52 spaced around the periphery of opening 30 in top 12 of stove 10. It will, of course, be understood that the bolt holes 48 in collar 40, the cut-outs 50 in gasket 42 and the notches 52 in opening 30 are cooperatively positioned so that bolts 46 will pass therethrough to engage nuts 44 positioned in the interior of stove 10 thus allowing the airtight securement of flue collar assembly 34 to the top 12 of stove 10.

Cover plate assembly 36 is generally similar to flue collar assembly 34 and is comprised of a cover plate 60, an annular gasket 62 and suitable nuts 64 and bolts 66. Bolts 66 pass through spaced bolt holes 68 in cover plate 60, through cut-outs 70 in gasket 62 and through corresponding notches 72 in the circumference of opening 32 in the rear wall 22 of stove 10. It will be understood that openings 30 and 32 are alike in size and in configuration, and further that bolt patterns of the flue collar 40, the cover plate 60 and the sealing gaskets 42 and 62 are all the same so that the flue collar assembly 34 and the cover plate assembly 36 are interchangeable. While the number of bolts, the specific bolt pattern and the sizes of openings 30 and 32 can be varied, they must be the same as each other so the flue collar assembly and cover plate assembly can be interchanged with each other.

Figure 2:
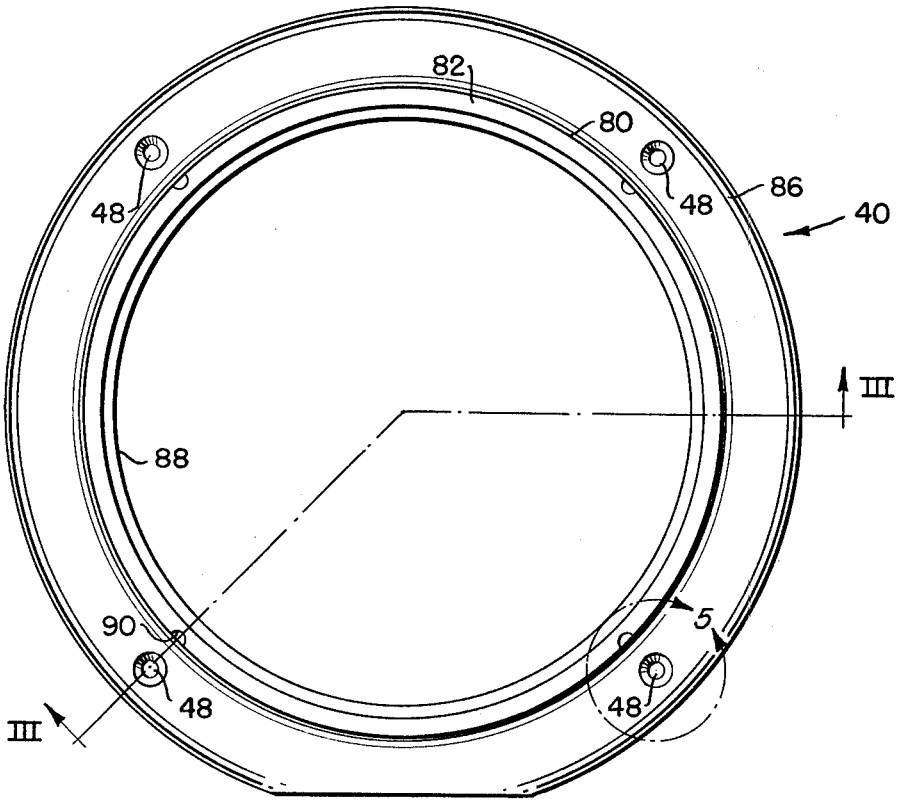
FIG. 2 is a top plan view of the flue collar assembly of the present invention.
Figure 3:
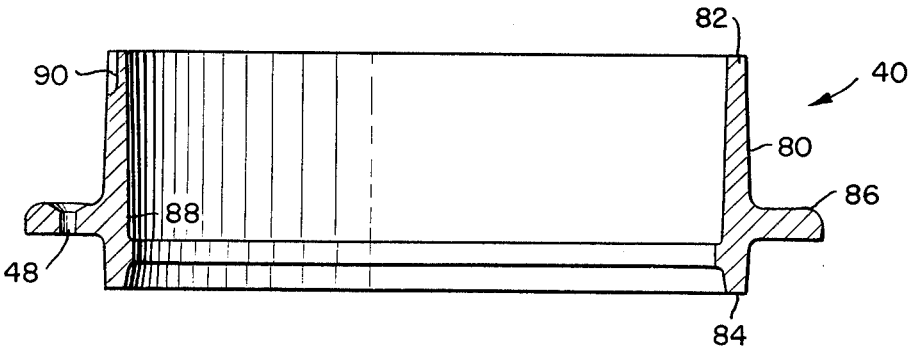
FIG. 3 is a cross-sectional side view of the flue collar assembly of FIG. 2 taken along line III—III of FIG. 2.
Figure 4:
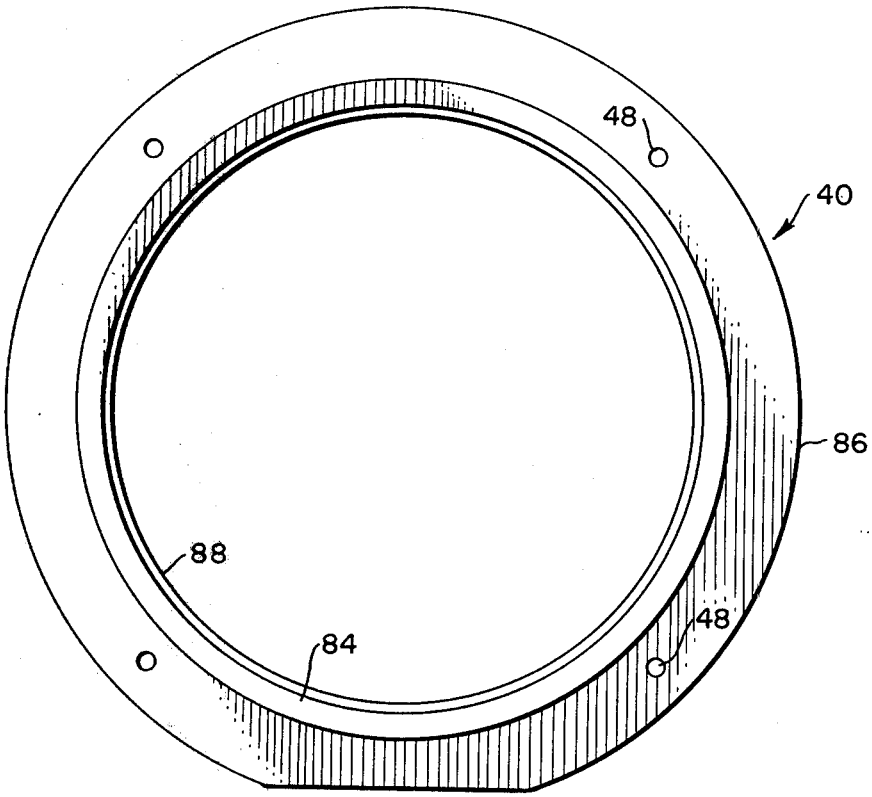
FIG. 4 is a bottom plan view of the flue collar assembly in accordance with the present invention.
Figure 5:
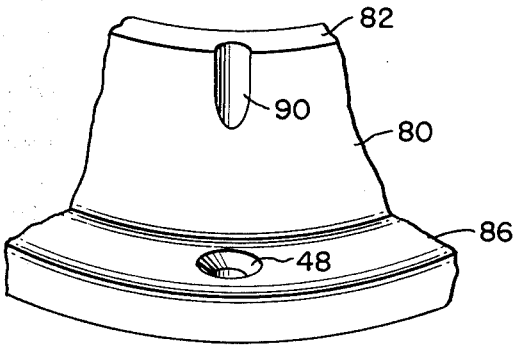
FIG. 5 is an enlarged perspective view of a portion of the flue collar assembly in accordance with the present invention, the portion so enlarged being shown encircled in FIG. 2.

Turning now to FIGS. 2–4, there is shown a flue collar 40 in accordance with the present invention. Collar 40 is formed as a generally cylindrical annular body 80 having an outwardly extending flange 86 which circumscribes the body 80 of the collar between the upper and lower ends, 82 and 84 respectively, of body 80. Flange 86 carries the spaced bolt holes 48 through which bolts 46 pass to secure collar 40 to the stove. An inwardly extending lip 88 is provided along the inner circumference of cylindrical body 80. This lip 88 supports the lowermost end of a stove pipe (not shown) which is placed within the flue collar's body section 80. As may be seen most clearly in FIG. 3, the inner circumference of annular body 80 is formed with a slight taper such that the inner diameter adjacent the upper end 82 is greater than the inner diameter adjacent lip 88. In this way, the stove pipe will form a snug fit as it is forced into body 80 and is forced downwardly against lip 88. The stove pipe is thus sealed in the flue collar 40 in an airtight manner. Further, any creosote or the like which is formed on the inner walls of the stove pipe runs back down into the combustion chamber of the stove and not onto the outer surface of the stove. The upper, outside wall portion of body 80 is provided with spaced $\frac{1}{4}''$ drill starts 90, as may be seen most clearly in FIG. 5. These drill starts provide a starting point for a drilled hole through which a screw can be placed to positively attach the stove pipe to the flue collar. Such a positive attachment is required in various localities.

In a preferred embodiment, flue collar 40 is formed with cylindrical body 80 being of 5/16" thick cast iron, having an outside diameter of $8\frac{3}{4}''$ and a nominal inside diameter of 8". The height of the body 80 is $3\frac{1}{8}''$ and the flange 86 is placed 2" below upper end 82. Lip 88 is $\frac{1}{4}''$ thick and $\frac{1}{4}''$ wide. Since the inner wall of body 80 tapers inwardly, the inner diameter is not the same from the top to the lip but decreases slightly from over 8" at top 82 to slightly less than 8" at lip 88. As described above, this insures a snug fit for a nominal 8" stove pipe. While these dimensions are of a preferred embodiment, it will be understood that the structure of the flue collar is adaptable to all stove pipe sizes currently marketed. For example, a smaller stove might use only a 4" stove pipe and the flue collar 40 and cover plate 60 would be sized accordingly. Thus the dimensions of the 8" collar set forth above are exemplary primarily of proportions of size rather than actual sizes.

Figure 6:
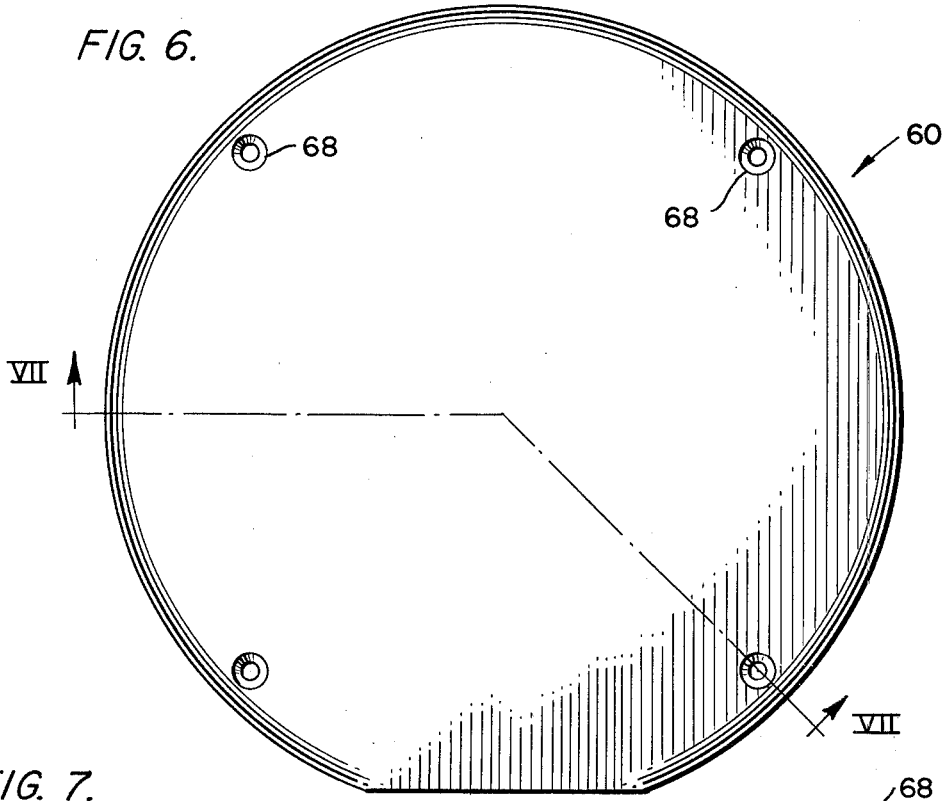
FIG. 6 is a top plan view of a cover plate assembly in accordance with the present invention.
Figure 7:
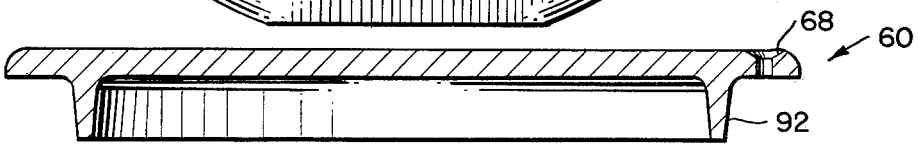
FIG. 7 is a cross-sectional view of the cover plate assembly of FIG. 6 taken along line VII—VII of FIG. 6.
Figure 8:
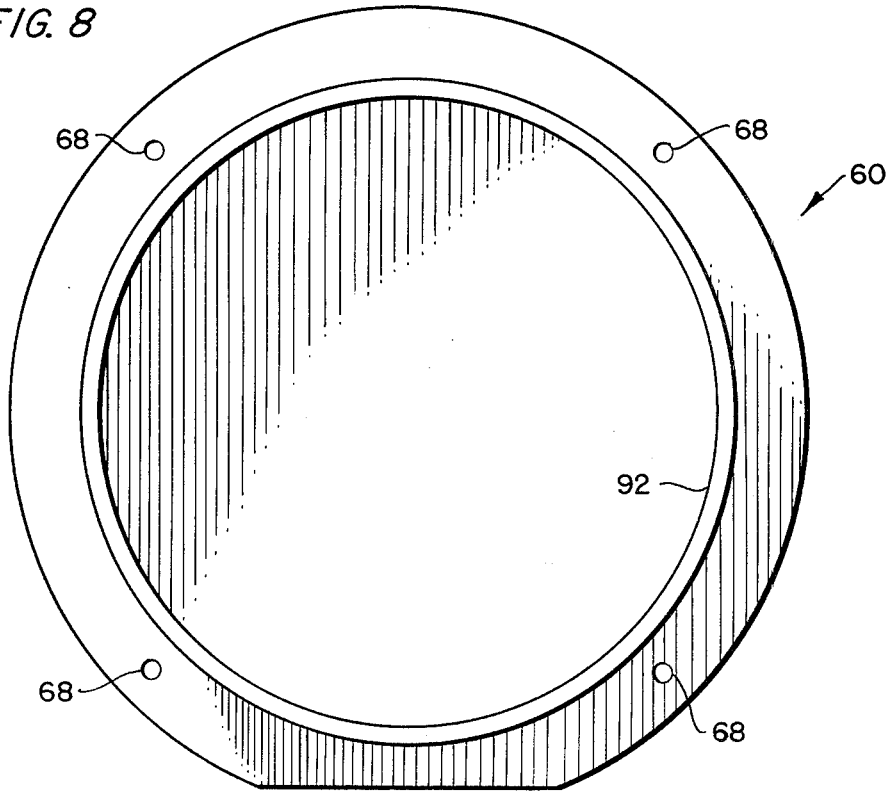
FIG. 8 is a bottom plan view of the cover plate assembly in accordance with the present invention.

Turning now to FIGS. 6–8, there may be seen a cover plate 60 in accordance with the present invention. As may be seen, cover plate 60 is generally a flat disk having spaced bolt holes 68 about its periphery, as was discussed previously. As shown most clearly in FIG. 7, a downwardly extending web 92 is formed on the lower surface of cover plate 60. Web 92 aids in positioning cover plate 60 in an opening in the top or rear wall of stove 10, such positioning being, of course, dependent on the location of the flue collar assembly 34. In the preferred embodiment, cover plate 60 has an outer diameter of $10\frac{5}{8}''$, a thickness of $\frac{3}{8}''$, and is formed from cast iron. The downwardly extending web 92 has an outer diameter of $8\frac{3}{4}''$, an inner diameter of $8\frac{1}{8}''$ and a thickness which tapers down from $\frac{3}{8}''$ to $\frac{1}{4}''$. As was the case with the dimension given for the flue collar, it will be obvious that the size of the cover plate can be varied and that these dimensions are intended more as indicative of proportions than of actual size. If desired, the cover plate can be provided with a company name, design, logo, or the like to make the cover more attractive.

In use, as has been discussed above, the flue collar assembly 34 is secured to the opening in either the top 12 or rear 22 of stove 10 depending on the location of the stove pipe. A suitable gasket material such as fiberfax® is used as gasket 42, and the flue collar assembly 34 is secured in place to form an airtight connection with the stove 10. The cover plate assembly 36 is secured to the remaining opening. The stove pipe is then inserted into the interior of the cylindrical body 80 and is wedged into place by the inward taper of the inner walls of body 80. The stove is now airtight and will burn efficiently and cleanly with no creosote drip onto the outside of the stove body. If, at some later time it becomes necessary to switch the flue collar assembly 34 and cover plate assembly 36, this is easily accomplished by loosening the bolts, changing the collar and cover and re-connecting the bolts.

While a full and complete description of a preferred embodiment of an airtight steel welded stove with dripless flue collar and cover plate assembly in accordance with the present invention has been set forth hereinabove, it will be obvious that changes in, for example, the dimensions of the stove, the dimensions of the flue collar assembly and cover plate assembly, the number and position of openings in the stove body and the like could be made without departing from the true spirit and scope of the invention and that the invention is to be limited only by the following claims.

We claim:

1. A dripless flue collar and cover plate assembly for an airtight welded steel stove, said flue collar and cover plate assembly comprising:

an airtight stove having a front wall, a rear wall, spaced side walls, a top wall, and a bottom;

first and second openings formed in first and second of said walls of said stove, said first and second openings being similarly shaped;

a flue collar interchangeably positionable in either of said first and second openings in said stove, said flue collar having an annular cylindrical body, said body being receivable in one of said first and second openings, and having an outwardly projecting flange intermediate end portions of said body, said flange having bolt holes through which securing bolts are passable to engage said stove to secure said flue collar to said stove, said body further having an inner inwardly tapering wall with an inwardly extending lip intermediate said ends, so that a stovepipe inserted within said body will snugly engage said inner tapering wall with an end of the stovepipe contacting said lip to return combustion residues to the combustion chamber of the stove for combustion so as to prevent drippage of the combustion residues onto the outside of the stove; and a cover plate interchangeably positionable in either of said first and second openings in said stove, said cover plate being a flat disk having spaced bolt holes about its periphery, through which securing bolts are passable to engage said stove to secure said cover plate to said stove, said cover plate further including a downwardly extending cylindrical web which has an outer diameter the same as an outer diameter of said cylindrical body and which is receivable in another of said first and second openings in said stove, wherein said flue collar and said cover plate are interchangeably positionable in said first and second openings.

* * * * *